United States Patent [19]

Piacentino

[11] 4,052,068

[45] Oct. 4, 1977

[54] GAME APPARATUS

[76] Inventor: Raymond C. Piacentino, 39 Cypress Road, Dumont, N.J. 07628

[21] Appl. No.: 734,533

[22] Filed: Oct. 21, 1976

[51] Int. Cl.[2] ..... A63F 7/00

[52] U.S. Cl. ..... 273/122 R

[58] Field of Search ..... 273/85 R, 85 C, 119 R, 273/119 A, 122 R, 122 A

[56] References Cited

U.S. PATENT DOCUMENTS

| | | | |
|---|---|---|---|
| 429,367 | 6/1890 | Stewart | 273/119 R |
| 672,839 | 4/1901 | Lounsbury | 273/119 R |
| 994,629 | 6/1911 | Amlie | 273/119 R |
| 1,942,476 | 1/1934 | Harris | 273/119 R |
| 2,668,057 | 2/1954 | Fry | 273/119 R |

*Primary Examiner*—Anton O. Oechsle
*Attorney, Agent, or Firm*—Robert A. Maikis

[57] ABSTRACT

Game apparatus is provided having a playing board with a series of alleys extending between two opposing players at opposite ends of the board. The alleys are defined by pairs of ball-guiding rails on the board. Ball projectors are provided at each end of each of the alleys and vision-obstructing dividers having openings therein for the alleys are disposed across the alleys so that each player can shoot balls into selected alleys of the opposing player and the opposing player will not know which alleys have been selected until the balls actually pass through the divider. Each player has ball diverters for his section of each alley to divert balls propelled toward him by the opposing player to a dead ball space and prevent the balls from reaching the end zone of the alley. The ball diverters comprise one or more ball diversion apertures in the board which communicate with a dead ball space beneath the board and which are partially obstructed by a laterally movable rail section controlled by the player and ball diversion gaps in the movable rail section which cooperate with another movable rail to divert the balls to a dead ball space on top of the board between the alleys.

14 Claims, 14 Drawing Figures

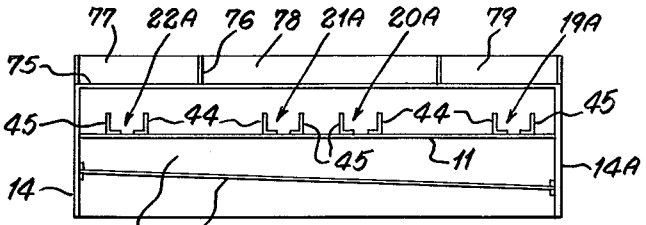
Fig. 5.
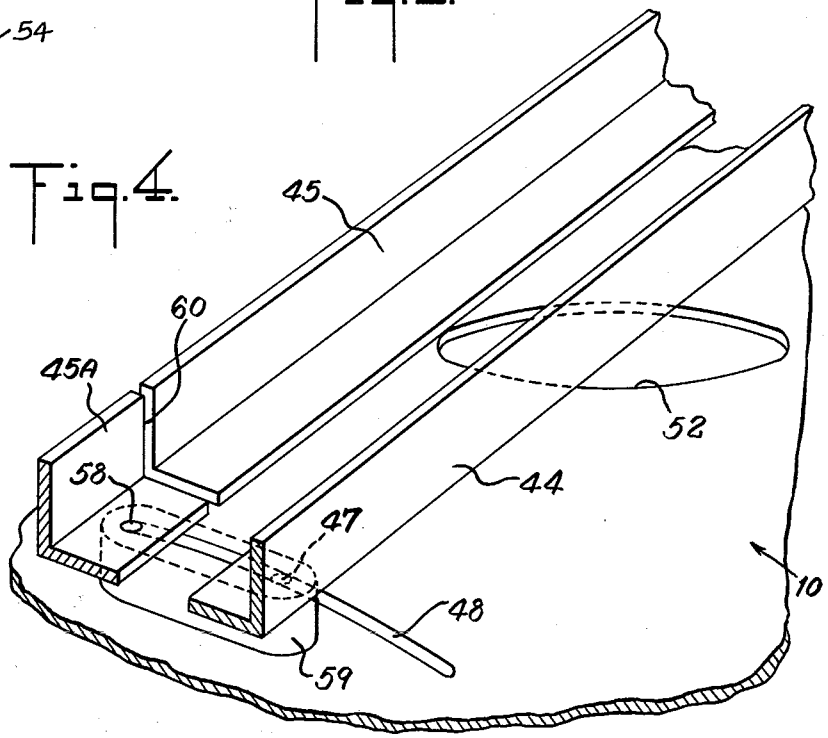
Fig. 4.
Fig. 6.
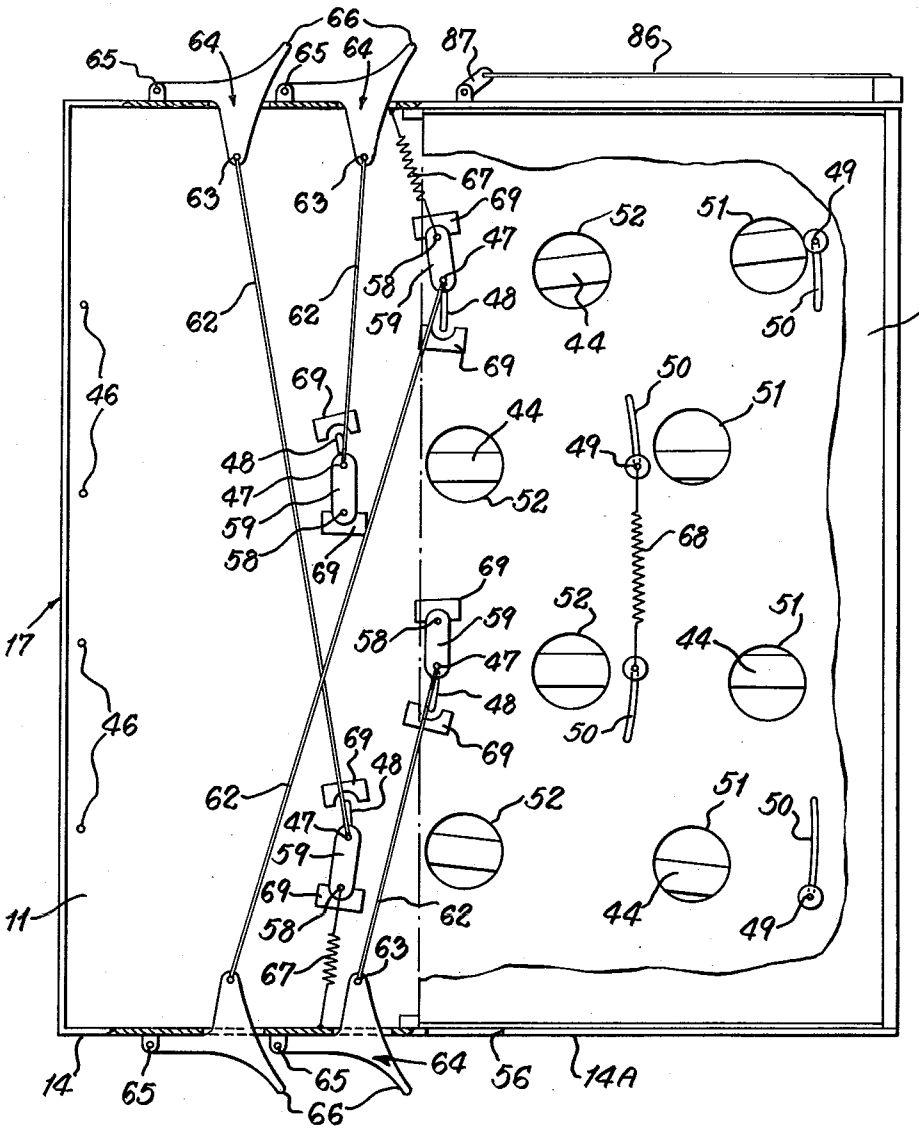

GAME APPARATUS

BACKGROUND OF THE INVENTION

1. Field of the Invention

This invention relates to recreational and training devices and more particularly to unique ball game apparatus which may be used for the playing of competitive games and which provides training and exercise in manual dexterity and physical-mental coordination for the players.

2. Description of the Prior Art

The wide variety of game apparatus available at the present time may be classified as either "mental games", such as checkers and the various board games, for example, or "physical games", such as table tennis, for example, which depend upon the physical dexterity of opposing players. A need exists for physical games which not only offer a high level of physical activity and competition but which also provide opportunity for mental competition between the players. A need also exists for game apparatus which may be used for the playing of a number of different games having different rules, so that the players interest in the apparatus is maintained for long periods of time. Suitable game apparatus should also provide training for the players in manual dexterity and physical-mental coordination and should be adapted for use by both adults and children. Finally, game apparatus should not only be compact and portable but should also be mechanically rugged in construction and provide substantially maintenance-free operation.

SUMMARY OF THE INVENTION

It is an object of this invention to provide game apparatus which is suitable for use by both adults and children and which may be employed in the playing of a number of different games having different rules.

It is a further object of this invention to provide game apparatus for opposing players which not only provides a high level of physical activity and training in manual dexterity for the players but also requires a high level of mental activity by the players which enhances physical-mental coordination of the players.

It is a still further object of this invention to provide game apparatus which is compact and rugged in construction and which is portable so that the apparatus may be easily moved to different locations.

It is an additional object of this invention to provide game apparatus which is substantially maintenance-free in operation and which provides a high degree of physical activity and movement without the use of complex mechanical or electrical mechanisms.

Briefly, the game apparatus of the invention comprises a playing board adapted to have a player stationed at each end thereof and a plurality of balls for the board. A series of alleys for the balls is provided on the board. Each of the alleys extends between the ends of the board and has an end zone at each end thereof. Vision-obstructing divider means is mounted on the board and extends transversely of the alleys to divide each of the alleys into two player-sections. The divider means has a height sufficient to prevent each player from visually observing the player alley sections of the opposing player. Player-operable ball propulsion means is provided at each end of each alley to propel balls along the alley so that each player can propel balls along selected player alley sections of the opposing player into the end zones thereof. Player-operable ball diversion means are provided in each player alley section adjacent the end zone thereof to divert balls propelled along the alley section to dead ball space outside of the alley, so that each player can divert balls propelled into his alley sections by the opposing player and prevent such balls from reaching the end zones thereof. The player alley sections may each comprise a pair of oppositely-disposed ball-guiding rails on the playing board. The ball diversion means comprises a laterally movable section of the rails, ball diversion opening means in the alley section communicating with the dead ball space, means coupled to the rail section for biasing the rail section to a closed position in which the rail section cooperates with the diversion opening means to prevent passage of balls therethrough, and player-operated control means coupled to the rail section for moving the rail section to an open position in which the rail section cooperates with the ball-diversion opening means to permit passage of balls therethrough. The game apparatus also includes high-point scoring trays which cooperate with deflector strips on the playing board and divider and pop-up panels in the divider means. Each player is also provided with ball feeding means to store and feed balls to his alley sections and stuck ball release means for relesing balls which become stuck between the divider and pop-up panels of the divider means.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 3 is a full vertical sectional view of the game apparatus of FIGS. 1 and 2 taken along the line 3—3 of FIG. 1;

FIG. 4 is a bottom plan view of one player end of the game apparatus of FIG. 1 with a portion of the ball return panel broken away to reveal details of construction;

FIG. 5 is a full vertical sectional view of the game apparatus of FIG. 1 taken along the line 5—5 in FIG. 2 of the drawings with the stuck ball control lever and the ball diversion control levers removed;

FIG. 6 is a fragmentary perspective view of the ball diversion means for one player alley section of the apparatus of FIG. 1;

DESCRIPTION OF THE PREFERRED EMBODIMENT OF THE INVENTION

Figure 1:
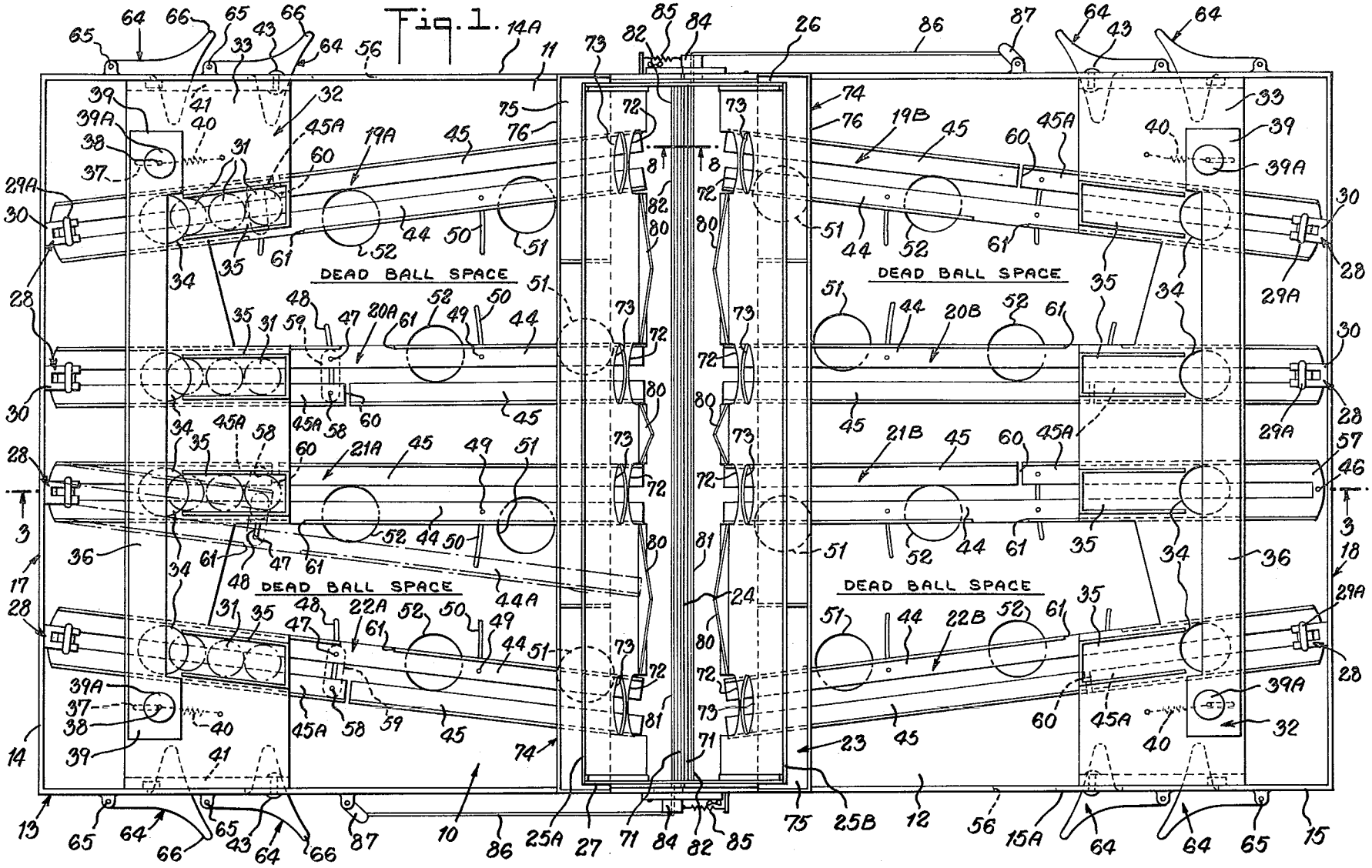
FIG. 1 is a top plan view of game apparatus constructed in accordance with the teachings of the invention with the ball propulsion means at one end of one of the alleys removed to reveal details of construction and with the ball diversion means for one of the alleys shown in an operated or open position by means of dotted line illustration.
Figures 2, 7, 8:
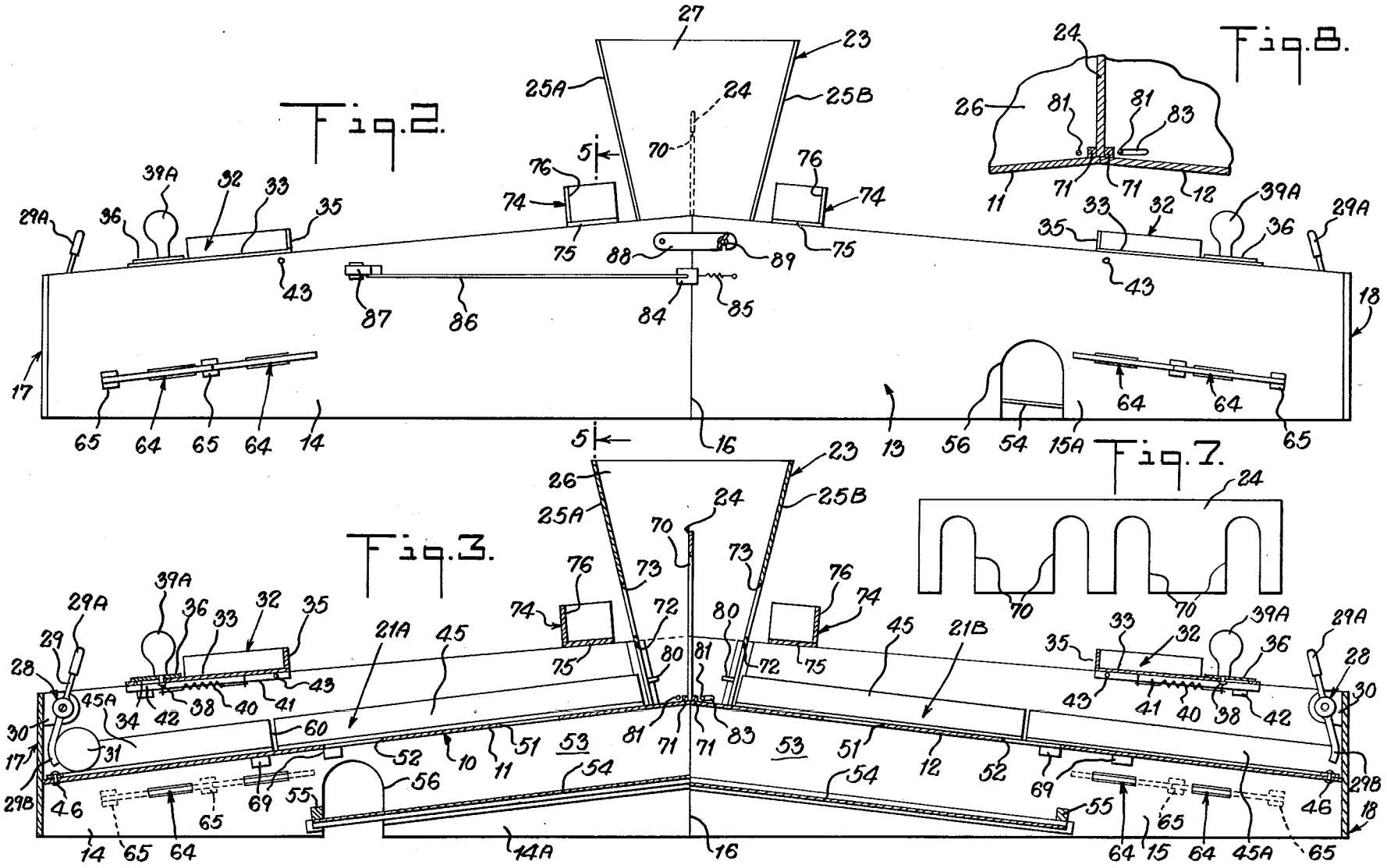
FIG. 2 is a side elevational view of the game apparatus of FIG. 1.
FIG. 7 is a reduced side elevational view of the divider panel of the vision-obstructing divider means showing the shape of the alley apertures formed therein.
FIG. 8 is an enlarged fragmentary sectional view of the game apparatus taken along the line 8—8 in FIG. 1 of the drawings showing the divider panel, deflector strips and stuck ball release cables.

Referring now to FIGS. 1, 2 and 3 of the drawings, there is shown game apparatus constructed in accordance with the teachings of the present invention. The apparatus comprises a playing board, indicated generally as 10, which consists of substantially rectangular support panels or sections 11 and 12. The support panels 11 and 12 are mounted on a substantially rectangular support frame or base, indicated generally as 13, which is divided into identical half-sections 14 and 15. The support panels 11 and 12 and the tops of the frame sections 14 and 15 are each vertically inclined and, as seen in FIG. 3, slope downwardly from the center 16 of the frame 13 to the ends, indicated generally as 17 and 18, of the frame. The playing board 10 is provided with a series of alleys, indicated generally as 19, 20, 21 and 22, which extend between the ends 17 and 18 of the board. Each of the alleys is divided into two player sections A and B by vision-obstructing divider means indicated generally as 23. The divider means comprises a vertically-disposed divider panel 24 and inclined pop-up panels 25A and 25B which are connected to and supported by a pair of side panels 26 and 27. The divider means has a height which is sufficient to prevent a player at either end of the game board from visually observing the player alley sections of the opposing player. For example, a player stationed at end 17 of the playing board would be unable to see the player alley sections 19B, 20B, 21B and 22B of the opposing player stationed at end 18 of the board. This may be accomplished by making the pop-up panels 25A and 25B of a suitable height and utilizing a divider panel 24 of a lesser height, as illustrated, or by making the divider panel 24 of sufficient vision-obstructing height and utilizing pop-up panels 25 of a lesser height.

Ball propulsion means, indicated generally as 28, are provided at each end of each of the alleys for propelling or shooting balls along the alleys so that each player can propel balls along selected player alley sections of the opposing player. The ball propulsion means are all identical in construction and may best be seen in FIGS. 1 and 3 of the drawings. Each propulsion means comprises a snap lever 29 which is pivotally mounted in a bifurcated mounting bracket 30 which is fixedly mounted on the inside wall of the frame 13. The snap lever 29 is arranged for rotation about a horizontal axis which is perpendicular to the longitudinal axis of the alley and is provided with a handle 29A and a curved lower portion 29B which engages a ball 31 as shown in FIG. 3. Since each of the player alley sections is inclined downwardly toward an end of the playing board, the balls 31 will roll downwardly under the force of gravity and come to rest against the curved lower portion 29B of the lever and will rotate the snap lever 29 until the end 29B rests against the inside wall of the frame 13. In order to propel the ball, the player hits the handle 29A of the snap lever toward the adjacent end of the playing board and the ball 31 will be propelled down the alley. The next ball placed in the alley will again roll downwardly and rotate the lever to position it for the next shot. If desired, the snap lever 29 may be made of a resilient material, such as spring steel or a suitable plastic, for example, so that a ball may be propelled down the alley by moving the snap lever handle away from the adjacent end of the board until the lower end 29B is pressed against the frame 13 and then releasing the lever so that the lower end thereof will spring back and propel the ball down the alley. Although the particular configuration shown for the ball propulsion means has the advantage of simplicity of construction and operation, it will be apparent that it could be replaced by other known types of ball shooters, such as a simple leaf spring arrangement or a spring-actuated plunger of the type used on pin ball machines, for example.

As seen in FIGS. 1, 2 and 3 of the drawings, ball feeding means, indicated generally as 32, are provided at both ends of the playing board for storing and feeding a plurality of balls 31 to the player alley sections. Each of the ball feeding means 32 is identical in construction and comprises a ball support panel 33 which is mounted on the top of the frame 13 and extends from side to side thereof. The ball support panel 33 is provided with four ball drop openings 34 which are disposed above the alleys 19 through 22 and which are suitably sized to permit the balls 31 to pass readily therethrough. Each of the openings 34 has associated with it a ball storage tray formed by a substantially U-shaped or open ended frame 35 which is mounted on the ball support panel 33. The ball storage trays are sized to hold the desired number of balls 31. For example, three balls may be stored in each tray as shown by the dotted line ball representation in FIG. 1. The ball feeding means 32 is also provided with an elongated movable panel section 36 which is slidably mounted on the ball support panel 33 by means of slots 37 and pins 38 which are located at the opposite ends 39 of the panel section. The slots 37 are disposed longitudinally of the playing board 10 so that the panel section 36 is also movable longitudinally of the board. A helical spring 40 is connected between the lower end of each of the pins 38 and the ball support panel 33 as seen in FIGS. 1 and 3 of the drawings, so that the movable panel section 36 is biased to a first position where it obstructs each of the ball drop openings 34 to prevent the balls stored in the trays 35 from dropping to the alleys below. The ends 39 of the movable panel section 36 are provided with handles 39A, so that a player may grasp the handles and move the panel section toward the end of the playing board to a second position in which the panel section does not obstruct the ball drop openings 34. Since the ball support panels 33 are mounted on the inclined top of the frame 13, they are also inclined downwardly toward the end of the playing board so that the balls in the storage trays will roll downwardly and into the ball drop openings by the force of gravity. By virtue of this arrangement, a single movement of the movable panel section 36 will drop four balls so that each of the alleys 19 through 22 will receive a single ball. If desired, the two handles 39A could be replaced by a single handle (not shown) in the center of the panel section 36. It will be noted that the ends of the ball support panel 33 are fixedly secured to mounting strips 41 which have one end thereof resting on lugs or projections 42 fixedly mounted on the inside walls of the frame 13. The other end of each of the strips 41 is pivotally supported by a pin 43 which passes through the frame 13 and the strip 41. Accordingly, the entire ball feeding means 32 may be rotated about the pins 43 by lifting the end of the support panel 33 nearest the player. This arrangement permits balls located at the ends of the player alley sections to be easily removed at the end of a player's turn as will be explained hereinafter.

As seen in FIGS. 1, 3, 4, 5 and 6 of the drawings, each of the player sections A and B of each of the alleys 19 through 22 is formed by two, substantially parallel, ball-guiding rails 44 and 45 which may be conveniently fabricated from members having an L-shaped cross-sectional area. The rail 44 of each alley section is laterally movable and has opened and closed positions. As seen in FIGS. 1, 3 and 4, each of the lateraly movable rails 44 is pivotally mounted for rotation about a pin 46 which secures the rail to the playing board 10 at the end of the rail adjacent the end of the playing board. The rail 44 is also slidably mounted on the playing board 10 by means of a pin 47 which passes through an arcuate slot 48 formed in the playing board and a pin 49 which passes through an arcuate slot 50 formed in the playing board. When the movable rail 44 is in the closed position it is substantially parallel to the oppositely-disposed rail 45 of each alley section and obstructs ball diversion apertures 51 and 52 which are formed in the playing board 10 beneath the rail 44. In this position, balls propelled along the alley will not fall into the apertures 51 and 52. When the rail 44 is moved to its open position, as shown by the dotted line representtion 44A for the alley section 21A in FIG. 1 of the drawings, it is seen that both of the ball diversion apertures 51 and 52 are no longer obstructed by the rail so that a ball travelling down the alley will pass through the apertures and be received in a dead ball space 53 lying underneath the playing board 10 in both player sections of the game apparatus. As seen in FIGS. 3, 4 and 5 of the drawings, the dead ball space 53 is formed by a ball return panel 54 which is inclined downwardly from the center 16 of the playing board toward the ends of the playing board. Each of the ball return panels 54 is provided with a rail or lip 55 at the lower end thereof to catch the dropped balls when they reach the bottom of the panel. Each of the panels 54 is also inclined downwardly toward one side of the frame 13 which is provided with a ball return opening 56. The ball return panel 54 for the frame section 14 is inclined downwardly towards side 14A of that frame section where the opening 56 is located. A similar ball return opening and inclined panel arrangement is provided for the side 15A of frame section 15, so that balls which are dropped through any of the ball diversion apertures 51 and 52 in both player sections of the playing board are received in the dead ball space 53 and returned through the ball return openings 56.

The ball-guiding rail 45 of each player alley section is fixedly mounted on the surface of the playing board 10 by any convenient means (not shown), such as riveting or cementing, for example, but is provided with a laterally movable portion 45A at the end of the rail adjacent the end of the playing board. The movable rail portion 45A has an end integrally connected by a curved portion 57 shown in alley 21B of FIG. 1 of the drawings, to an end of movable rail 44, so that the rail portion 45A will pivot about the pin 46 when the movable rail 44 is laterally moved. Rail portion 45A is also slidably mounted on the playing board 10 by means of a pin 58 which passes through the slot 48 in the playing board. The pin 47 which secures the movable rail 44 to the playing board is connected to the pin 58 for the movable rail portion 45A by means of a connector block 59 which is located beneath the playing board, so that the rail portion 45A is moved in synchronization with the movement of rail 44 about the pivot pin 46. If desired, the integral connction 57 between the ends of the rails 44 and 45A may be omitted and each rail may be separately pivoted to permit the same synchronous movement.

Referring again to FIG. 1 of the drawings, it will be seen that when movable rail 44 is moved to its open position at 44A, an end 60 of movable rail portion 45A will be moved to a position where it lies between the rails 45 and 44 and obstructs the alley section, so that a ball travelling down the alley will strike the end 60 of the rail and be deflected to a second dead ball space between that alley and the adjacent alley through a ball diversion gap 61 formed in the movable rail 44. When the movable rails are in the closed position the end 60 of rail portion 45A no longer obstructs the alley and balls are not deflected through the gap 61. The connector blocks 59 which interconnect the movable rail 44 and movable rail portion 45A are each connected by a cable 62 as shown in FIG. 4 of the drawings to one end 63 of a triple-ended control lever 64 which is pivotally mounted at end 65 thereof to the frame 13. Each of the control levers 64 have a handle end 66 which may be actuated by the players. In the construction of alleys 19 and 22, the pin 58 which connects the movable rail portion 45A to the connector block 59 is connected by a helical spring 67 to the frame 13, so that the movable tracks for these alleys are normally biased to a closed position and will be opened by movement of the appropriate control levers 64 by the players. With respect to alleys 20 and 21, it will be seen that the pins 49 which are connected to the movable rails 44 are interconnected by a helical spring 68, so that the movable tracks of these alleys are also normally biased to a closed position and will be moved to the open position by player actuation of the control levers 64 for these alleys. As seen in FIG. 4, each of the connector blocks 59 for the various player alley sections cooperate with projecting lugs or stops 69 which are mounted on the underside of the playing board 10 so that the movable rail sections of each alley section will be moved to well-defined open and closed positions.

The foregoing arrangement of rails 44 and 45, apertures 51 and 52 and gap 61 forms the ball diversion means of the game apparatus in which a laterally movable section of the rails cooperates with ball diversion opening means in the alley sections to control the passage of balls through the apertures 51 and 52 and the gap 61 to the dead ball spaces associated therewith. The ball diversion function is accomplished by two mechanism in each player alley section. In the first mechanism, the ball diversion apertues 51 and 52 function as the ball diversion opening means and the movable rail 44 functions as the laterally movable rail section which cooperates with the apertures to divert balls propelled along the alleys into the dead ball space 53 lying below the playing board 10, so that each player can divert balls propelled into his alley sections by the opposing player by actuation of the appropriate control levers 64. It is believed apparent that the entire length of rail 44 need not be movable to accomplish this function, since only a portion of this rail adjacent the apertures 51 and 52 need be moved. In the second mechanism, the movable rail section is the movable rail 44 and movable rail portion 45A and the ball diversion opening means is the gap 61 in the rail 44. This combination diverts balls propelled along the alleys to the dead ball space lying adjacent the alleys on the upper side of the playing board 10. It will therefore be understood that either or both of these mechanisms could be employed as the ball diversion means in the game apparatus of the invention.

As seen in FIGS. 2 and 7 of the drainings, the divider panel 24 of the vision-obstruction divider means 23 is provided with a series of elongated alley apertures 70 which are aligned with the alleys 19 through 22, so that balls propelled along the alleys may pass between the player sections of the alleys. In FIGS. 1, 3 and 8 of the drawings, it is seen that a pair of deflector strip 71 are provided on the playing board disposed on opposite sides of the divider panel 24 and extending between the opposite sides of the board across all the alleys. The deflector strips 71 function to deflect balls upwardly which are propelled along the alleys through the apertures 70 for reasons which will be explained hereinafter. The divider panel 24 is removable and is inserted into the space between the deflector strips 71. The construction of the pop-up panels 25A and 25B is shown in FIGS. 1 and 3 of the drawings wherein it is seen that ech of these panels is provided with a series of alley openings 72 which are aligned with the alleys 19 through 22 and which permit balls travelling along these alleys to pass therethrough. Each of the pop-up panels is also provided with a series of scoring openings 73 which are vertically aligned with and spaced above the alley openings. The scoring openings are also adapted to permit the balls 31 to pass therethrough and communicate with a high point scoring tray, indicated generally as 74. The pair of scoring trays 74 are mounted on the playing board on opposite sides of the vision-obstructing divider means 23 and extend transversely of the alleys. Each of the high point scoring trays 74 is formed by a substantially rectangular support panel 75 which is mounted on the top of the frame 13 and a vertically extending frame structure 76 which cooperates with the panel to provide three ball-catching scoring compartments 77, 78 and 79 as shown in FIG. 5 of the drawings. The scoring tray itself is disposed between the series of alley openings 72 and the series of scoring openings 73 so that the compartments will catch balls passing through the scoring openings. The scoring compartments 77 and 79 are respectively aligned with alleys 22 and 19 while the center compartment 78 is aligned with both of the alleys 20 and 21.

When a ball is propelled along alley 19, the ball will strike the deflector strip 71 and will be deflected upwardly so that it may pass through either the alley opening 72 or the scoring opening 73 for that alley in the pop-up panel. If the ball passes through the alley opening 72 it will proceed down the alley section of the opposing player. If the ball passes through the scoring opening 73, it will drop into scoring compartment 79 and the player shooting the ball will receive an extra point score. In a similar fashion, a ball passing along alley 22 will either pass into the alley section of the opposing player or into the scoring compartment 77, while balls propelled down alleys 20 and 21 will either pass to the opposing player's alley sections or into the scoring compartment 78. As will be explained hereinafter, the three scoring compartments may be assigned different high point scoring values.

The alley apertures 70 which are formed in the divider panel 24 are elongated to accomodate any upward deflection of the balls 31 caused by the balls striking the deflector strips 71, so that the balls may pop upwardly into the scoring openings 73 depending on the velocity with which the balls are propelled down the alley. Occasionally, a ball which is propelled through the alley apertures in the divider panel 24 will not pass through either of the alley openings 72 or the scoring openings 73 in the pop-up panel but will land in the space between the divider panel and the adjacent pop-up panel. To prevent these balls from becoming stuck between the two panels, each of the pop-up panels 25A and 25B is provided with triangular-shaped projections 80 which extend laterally between adjacent alley openings 72, so that balls landing in these spaces will tend to roll toward one or the other of the adjacent alley openings and into the alley sections of the opposing player. The same arrangement permits balls which are propelled by a player and which fail to pass through the divider panel 24 to be returned to that player. If a ball becomes stuck and fails to roll to an adjacent alley opening 72, it may be moved by the pair of stuck ball release means which are disposed on opposite sides of the divider panel 24. Each of the stuck ball release means comprises a stuck ball release cable 81 which is fixedly secured at one end 82 thereof to the frame 13 at one side of the playing board. The other end of the cable 81 passes through a slot 83 in the frame and is secured to a slidable member or block 84 which is disposed exteriorly of the frame. The movable block 84 is connected by a helical spring 85 to the frame so that the release cable 81 is biased to a position wherein it is substantially parallel to the deflector strips 71. The block 84 is coupled by a cable 86 to a stuck ball control lever 87 which is pivotally mounted on the frame 13 adjacent the end of the playing board. When the lever 87 is rotated by a player, the block 84 and the attached release cable end are slidably moved along the slot 83, so that the cable 81 is rotated about its fixed end 82. This rotational movement of the release cable will serve to dislodge any of the balls 31 which may become stuck between the divider panel and the pop-up panels.

The operation of the game apparatus of the invention will now be described. A player is stationed at each of the ends 17 and 18 of the playing board. One of the players is provided with a plurality of the balls 31 which are placed in the ball storage trays 35 of the ball feeding means 32. This player actuates the handles 39A of the feeding means and a ball is dropped in each of the alleys 19 through 22 where it rolls down to a position in which it engages the ball propulsion levers 29. The object of the game is to have the player who is shooting the balls project as many balls as possible into the end zone of each of the alley sections of the opposing player. The end zone may be defined as that portion of an alley section which extends along the movable rail portion 45A since it is virtually impossible for the opposing player to divert or remove the balls from the alley when they are in this portion of the alley. The opposing player tries to prevent the propelled balls from entering the end zones in his section of the playing board by operating the control levers 64 which control the movable rail sections of his alley sections. The player who shoots the balls propels them by operating the four ball propulsion means 28 as quickly as possible and in an unexpected sequence. Since the height of the divider means 23 prevents the opposing player from visually observing the propelled balls until they actually pass through the alley openings 72 in the pop-up panel on his end of the board, the opposing player does not know the order in which the balls will be propelled down the alleys and therefore has a very short time in which to manipulate the appropriate control levers 64 to cause the balls to either drop into the ball diversion apertures 51 and 52 or be diverted through the ball diversion gap 61 in the movable rail 44. If the opposing player is successful in moving the appropriate control levers quickly enough to divert the balls into the dead ball spaces located adjacent the alleys or the dead ball space 53 located below the playing board, the balls are prevented from reaching the end zones of the alleys. The control levers 64 at each end of the playing board are so spaced that only one may be operated at a time by the player at that end of the board. Accordingly, the defending player must move quickly to divert the balls since he does not know the order in which the balls will be propelled down the four alleys at his end of the board. When the player who is shooting the balls has shot all four of the balls lying in his alley sections, he operates the levers 39A of the ball feeding means to drop four more balls into the alleys and repeats the operation until all of the balls stored in the ball storage trays are gone.

By suitably controlling the velocity with which the balls are propelled down the alleys, the player shooting the balls can try to cause them to pop-up into the scoring openings 73 formed in the pop-up panels 25, so that they land in one of the three high point scoring compartments 77, 78 and 79 on the opponents side of the divider panel. Each of the scoring compartments may be assigned extra point scoring values which are higher than the point scores given for balls which are propelled into the end zones of the alleys. The centrally-disposed divider panel 24 functions to prevent balls which are propelled by the shooting player from striking the pop-up panel on the defending player's side of the divider and bouncing back into the alleys of the shooting player. When the player who is shooting the balls discovers that a ball is stuck between the divider and pop-up panels on his side of the divider panel, he may release it by actuating the stuck ball control lever 87 which moves the ball release cable 81. He will then have an opportunity to shoot this ball again. When the first player's turn to shoot the balls is finished, the balls are given to the opposing player and the opposing player will shoot the balls and the first player will defend by actuating the control levers 64 at his end of the playing board. If desired, the alley apertures 70 in the divider panel 24 may be closed by suitable covers (not shown) or the divider panel may be replaced by a solid panel without apertures, so that balls propelled down the alleys by a player will strike the divider panel and bounce back to pass through either the alley openings 72 or the scoring openings 73 in the pop-up panel on that player's side of the board. This arrangement permits the game apparatus to be used by a single player since the same player not only propels the balls down the alleys but also operates the control levers for the ball diversion means.

The game apparatus of the invention is suitable for playing a number of different games having different rules. For example, the player shooting the balls may be provided with sixteen balls, of which four are placed in the alleys and twelve are placed in the ball storage trays 35 at his end of the playing board. For each ball that he propels into the end zones at the opposing player's end of the board, the shooting player may earn one point. Balls which the shooting player propels into the high point scoring compartments 77 and 79 may be worth three points, while balls which are propelled into the central scoring compartment 78 may be given two points. Balls which the opposing player diverts into the dead ball spaces receive no points. After both players have taken a turn shooting the balls, their respective point scores are totalled and the player with the higher point total wins the game. Under another set of game rules, the player who shoots the balls receives scoring points only if the balls are propelled into the high point scoring compartments on the opponents side of the playing board. If the balls are projected into the opponent's alley sections and reach the end zones thereof they would receive no points. The player who is defending, however, would receive one or more points for each ball which he diverts into a dead ball space. The points earned by the different players are subtracted from each other and the net point score is given to the player having the most points. For example, if the shooting player received a point score of six from balls landing in the high point scoring compartments and the defending player successfully diverted seven balls to the dead ball space, the defending player would receive one point. If the shooting player's point score exceeded the defending player's point score, the shooting player would receive a score equal to the difference between the point scores. The procedure would then be repeated with the defending player taking his turn at shooting the balls. At the end of the game, the player having the higher score would win. Accordingly, it will be apparent that the game apparatus of the invention may be employed to play a virtually unlimited number of games having different rules. The physical-mental coordination of the players is enhanced because the shooting player must select a sequence of shooting the balls which the defending player does not expect and the defending player must anticipate the sequence or must move quickly enough to divert the balls when they appear on his side of the divider panel.

The component parts of the game apparatus may be fabricated from a wide variety of materials, such as wood, metal or suitable plastics, for example. The fixed rails of the alley sections may be fabricated as an integral part of the playing board 10 if desired. The ball feeding means 32 at both ends of the game could be removed from the frame by removing the pivot pins 43 and the entire divider means 23, including the divider panel 24 and the pop-up panels 25, may be removed so that the two halves 14 and 15 of the frame may be separated for easy portability. As seen in FIG. 2 of the drawings, frame half 14 is provided with a pivoted latch member 88 which is adapted to engage a pin 89 mounted on frame section 15, so that both frame sections are held firmly together when the game is assembled. The playing balls 31 may be made of wood, plastic or other suitable material. Accordingly, the game apparatus of the invention is mechanically rugged and has a high degree of portability.

It is believed apparent that many changes could be made in the construction and described uses of the foregoing game apparatus and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. Game apparatus comprising a playing board adapted to have a player stationed at each end thereof;

a plurality of balls;

a series of alleys for said balls on said board, each of said alleys extending between the ends of said board and having an end zone at each end thereof;

vision-obstructing divider means mounted on said board and extending transversely of said alleys for dividing each of said alleys into two player-sections, said divider means having a height sufficient to prevent each player from visually observing the player alley sections of the opposing player;

player-operable ball propulsion means at each end of each of said alleys for propelling said balls along said alleys, so that each player can propel balls along selected player alley sections of the opposing player into the end zones thereof; and player-operable ball diversion means in each player alley section adjacent the end zone thereof for diverting balls propelled along the alley section to dead ball space outside of the alley section, so that each player can divert balls propelled into his alley sections by the opposing player and prevent such balls from reaching the end zones thereof.

2. Game apparatus as claimed in claim 1 wherein each of said player alley sections comprises a pair of oppositely-disposed ball-guiding rails on said playing board; and said ball diversion means comprises a laterally movable section of said rails, ball diversion opening means in said player alley section adapted to receive said balls and communicating with said dead ball space, means coupled to said movable rail section for biasing said rail section to a closed position in which said rail section cooperates with said ball diversion opening means to prevent passage of said balls therethrough, and player-operated control means coupled to said movable rail section for moving said rail section to an open position in which said rail section cooperates with said ball diversion opening means to permit passage of said balls therethrough.

3. Game apparatus as claimed in claim 2 wherein said dead ball space is disposed beneath said playing board;

said laterally movable rail section comprises at least a portion of one of said rails; and said ball diversion opening means comprises a ball diversion aperture in said playing board, said aperture being obstructed by said one rail portion in said closed position to prevent passage of balls therethrough and being unobstructed by said one rail portion in said open position to permit passage of balls therethrough.

4. Game apparatus as claimed in claim 2 wherein said dead ball space is disposed on top of said playing board adjacent the alley section;

said ball diversion opening means comprises a ball diversion gap in one of said rails; and said laterally movable rail section comprises at least a portion of said one rail, an oppositely-disposed portion of the other of said rails having an end thereof opposite said gap, and means connecting said rail portions for synchronous movement thereof to cause said rail portion end to obstruct the alley section in said open position and deflect balls through said gap and not to obstruct the alley section in said closed position so that balls are not deflected through said gap.

5. Game apparatus as claimed in claim 2 wherein said dead ball space comprises a first space on top of said playing board adjacent the alley section, and a second space beneath said playing board;

said ball diversion opening means comprises a ball diversion gap in one of said rails communicating with said first dead ball space, and at least one ball diversion aperture in said playing board communicating with said second dead ball space; and said laterally movable rail section comprises at least a portion of said one rail adjacent said ball diversion aperture, an oppositely-disposed portion of the other of said rails having one end thereof opposite said ball diversion gap, and means interconnecting said rail portions for synchronous movement thereof between said closed position in which said aperture is obstructed by said portion of said one rail and said alley section is not obstructed by said one end of said other rail portion to prevent passage of balls through said aperture and said gap and said open position in which said aperture is not obstructed by said one rail portion and said alley section is obstructed by said one end of said other rail portion to deflect balls through said gap and permit passage of balls through said aperture and said gap.

6. Game apparatus in claim 5 wherein said biasing means comprises a spring connected to one of said movable rail portions; and said control means comprises a lever movably mounted on said playing board adjacent the end of the alley section associated therewith.

7. Game apparatus as claimed in claim 2 wherein said divider means comprises a substantially vertically-disposed divider panel separating the player sections of said alleys and having alley apertures therein aligned with said alleys to permit movement of balls between the player sections of each alley; and said playing board comprises a pair of board sections disposed on opposite sides of said divider panel and sloping downwardly therefrom, so that balls propelled by a player which fail to pass through said alley apertures are returned to that player.

8. Game apparatus as claimed in claim 2 further comprising ball feeding means mounted on and spaced above said playing board adjacent each end thereof for storing and feeding said balls to the player alley sections associated therewith, said ball feeding means comprising a ball support panel extending across and spaced above the player alley sections associated therewith, said ball support panel sloping downwardly toward the playing board end associated therewith, a series of ball drop openings in said ball support panel at the lower end thereof aligned with the player alley sections, a movable panel section slidably mounted on said ball support panel for sliding movement between a first position in which said panel section obstructs each of said ball drop openings to prevent passage of balls therethrough and a second position in which said panel section does not obstruct said ball drop openings to thereby permit passage of balls therethrough, means coupled to said movable panel section for biasing said panel section to said first position, and a series of open-ended ball storage trays on said ball support panel at the higher end thereof aligned with said ball drop openings for storing and feeding balls thereto.

9. Game apparatus as claimed in claim 7 wherein said divider means further comprises a pair of inclined pop-up panels disposed on opposite sides of said divider panel and spaced a distance therefrom, each of said pop-up panels extending transversely of said alleys and having a series of alley openings therein aligned with said alleys to permit passage of balls along said alleys, and a series of scoring openings therein to permit the passage of balls therethrough, said scoring openings being vertically aligned with and spaced above said alley openings; and said game apparatus further comprises a pair of scoring trays having ball catching scoring compartments thereon mounted on said playing board on opposite sides of said divider means, each of said scoring trays extending transversely of said alleys and being disposed between said series of alley openings and said series of scoring openings in the pop-up panel adjacent thereto so that said scoring compartments are adapted to receive balls passing through said scoring openings, and deflector strips on said playing board on opposite sides of said divider panel, said deflector strips extending transversely of said alleys to cause balls propelled along the alleys to strike said strips and be deflected upwardly, so that the deflected balls may pass through either said alley openings or said scoring openings.

10. Game apparatus as claimed in claim 9 further comprising a pair of stuck ball release means disposed on opposite sides of said divider panel for releasing balls which become stuck between said divider and pop-up panels, each of said release means comprising a stuck ball release cable extending transversely of said alleys and disposed between said divider panel and the adjacent pop-up panel, said cable having one end thereof fixedly secured to one side of said playing board and the other end thereof slidably mounted on the other side of said playing board to permit rotational movement of said cable about said one end thereof in response to sliding movement of the other end thereof, and a stuck ball control lever movably mounted on said playing board adjacent an end thereof and coupled to said other end of said cable for slidably moving said other cable end.

11. Game apparatus as claimed in claim 9 further comprising triangular-shaped projections on each of said pop-up panels extending laterally between adjacent alley openings to cause balls landing between adjacent alley openings in the space between said divider and pop-up panels to roll toward one or the other of said adjacent alley openings.

12. Game apparatus as claimed in claim 9 wherein the alley apertures in said divider panel are closed so that balls propelled along the alleys by a player strike said divider panel and are bounced back toward that player through the alley openings or the scoring openings in the pop-up panel on that player's section of said playing board, whereby the game apparatus may be used by a single player.

13. Game apparatus as claimed in claim 5 wherein the rails of said pair of rails are substantially parallel to each other in said closed position; and said oppositely-disposed rail portions comprising said laterally movable rail section are pivotally mounted on said playing board for rotational movement into said open position.

14. Game apparatus as claimed in claim 13 wherein said laterally movable rail section comprises a single substantially hook-shaped member having the closed end thereof pivotally mounted on said playing board.

* * * * *